US010960463B2

(12) United States Patent
Dangler et al.

(10) Patent No.: US 10,960,463 B2
(45) Date of Patent: Mar. 30, 2021

(54) EMBEDDING THERMALLY-RESISTANT FLEXIBLE CABLING WITHIN A METAL CASTING DURING DIE-CASTING

(71) Applicant: International Business Machines Corporation, Armonk, NY (US)

(72) Inventors: John R. Dangler, Rochester, MN (US); Austin Carter, Rochester, MN (US); Gunnar Mills, Rochester, MN (US); Colin E. Masterson, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 16/190,943

(22) Filed: Nov. 14, 2018

(65) Prior Publication Data

US 2020/0147680 A1 May 14, 2020

(51) Int. Cl.

| | |
|---|---|
| ***B22D 19/00*** | (2006.01) |
| ***B22D 17/20*** | (2006.01) |
| *C22C 18/04* | (2006.01) |

(52) U.S. Cl.

CPC ..... *B22D 19/00* (2013.01); *B22D 17/20* (2013.01); *C22C 18/04* (2013.01)

(58) Field of Classification Search

CPC ..... B22D 19/00; B22D 17/20; C22C 18/04

See application file for complete search history.

(56) References Cited

U.S. PATENT DOCUMENTS

| | | | | |
|---|---|---|---|---|
| 4,739,738 | A | 4/1988 | Sander et al. | |
| 5,013,507 | A | 5/1991 | Julien et al. | |
| 5,996,219 | A | 12/1999 | Golnas et al. | |
| 6,015,953 | A * | 1/2000 | Tosaka | H01R 4/20 174/79 |
| 9,500,561 | B2 * | 11/2016 | Sutton | G01M 11/086 |
| 2009/0309427 | A1 | 12/2009 | Menhart | |
| 2017/0021410 | A1 * | 1/2017 | Stumpf | B22D 19/00 |
| 2017/0321661 | A1 | 11/2017 | Mieritz et al. | |

FOREIGN PATENT DOCUMENTS

| | | | | |
|---|---|---|---|---|
| EP | 1046446 | A1 * | 10/2000 | B22D 19/00 |
| WO | WO 2004/105176 | A3 | 12/2004 | |

OTHER PUBLICATIONS

"Diecasting Alloys", Eastern Alloys Inc, Aug. 3, 2011, https://web.archive.org/web/20110803180616/http://www.eazall.com/diecastalloys.aspx (Eastern Alloys) (Year: 2011).*

"Carbon Fiber", American Elements, Apr. 18, 2016, https://www.americanelements.com/carbon-fiber-7440-44-0 (American Elements) (Year: 2016).*

(Continued)

*Primary Examiner* — Daniel J. Schleis
*Assistant Examiner* — Kevin C T Li
(74) *Attorney, Agent, or Firm* — Nathan Rau

(57) ABSTRACT

The present disclosure describes embedding thermally-resistant flexible cabling within a metal casting during die-casting. A die-casting process may include fixing the thermally-resistant flexible cabling within a die, and die-casting the metal to form a metal casting having the thermally-resistant flexible cabling embedded within the metal casting. In some cases, the thermally-resistant flexible cabling may be utilized for grounding of the metal casting.

19 Claims, 3 Drawing Sheets

(56) References Cited

OTHER PUBLICATIONS

"Metals—Melting Temperatures", The Engineering Toolbox, "Melting Temperatures of Some Common Metals and Alloys", Mar. 6, 2016, https://www.engineeringtoolbox.com/melting-temperature-metals-d_860.html (Engineering Toolbox) (Year: 2016).*
"Dupont Pyralux HT", 2005, pp. 1-4 (Dupont) (Year: 2005).*
Pille, C., *In-Process Embedding of Piezo Sensors and RFID Transponders into Cast Parts for Autonomous Manufacturing Logistics*, Smart Systems Integration, 4th Conference & Exhibition on Integration Issues of Miniaturized Systems—MEMS, MOEMS, OCs and Electronic Components, Como, Italy, ISBN 978-3-8007-3208-1, <<https://pdfs.semanticscholar.org/b96d/ba68173f18cdf464791f12ba06796a7fa7f4.pdf>>, Mar. 23-24, 2018, 10 pages.
Eastern Alloys Inc., *Zinc Die Casting Alloys*, <<https://www.eazall.com/diecastalloys.aspx>>, 2012, printed Jul. 10, 2018, 5 pages.

* cited by examiner

EMBEDDING THERMALLY-RESISTANT FLEXIBLE CABLING WITHIN A METAL CASTING DURING DIE-CASTING

BACKGROUND

Passing cables through metal castings typically requires an additional mechanism or post-machining operations and assembly after forming the metal casting. The high temperatures required to cast metal has prevented cables from being embedded into metal for grounding, shielding, or communication. This has instead been accomplished with gasketing and physical contact.

SUMMARY

According to an embodiment, an article of manufacture containing thermally-resistant flexible cabling is disclosed. The thermally-resistant flexible cabling is embedded within a metal casting during die-casting.

According to another embodiment, a die-casting process includes fixing a thermally-resistant flexible cabling within a die. After fixing the thermally-resistant flexible cabling within the die, the process includes die-casting an alloy to form a metal casting having a thermally-resistant flexible cabling embedded within the metal casting.

According to yet another embodiment, a process includes embedding a thermally-resistant flexible cabling within a metal casting during die-casting. The process includes utilizing the thermally-resistant flexible cabling for grounding of the metal casting.

The foregoing and other objects, features, and advantages of the invention will be apparent from the following more particular descriptions of exemplary embodiments of the invention as illustrated in the accompanying drawings wherein like reference numbers generally represent like parts of exemplary embodiments of the invention.

DETAILED DESCRIPTION

The present disclosure describes the utilization of thermally-resistant flexible cabling to embed cabling into or through metal castings for purposes of grounding the cast part or passing signals through the casting. In the present disclosure, thermally-resistant flexible cabling that is capable of withstanding the casting temperature of certain materials, such as various zinc aluminum (ZA) alloys (also commonly referred to as "zamak" materials), enables the cables to be embedded into a metal casting for grounding, shielding, or communication. Other materials or alloys may be used. In a particular embodiment, the thermally-resistant flexible cabling of the present disclosure may be able to withstand temperatures in the 450 to 500° C. range for brief exposure, above the temperatures required to die-cast a variety of ZA alloys. Such cabling may include, for example, DuPont™ Pyralus® HT (heat resistant flexible cable).

Zamak is a family of alloys with a base metal of zinc and alloying elements of aluminum, magnesium, and copper. Zamak alloys are most commonly die-cast. To illustrate, zamak 3 has the base composition for the zamak alloys (96% zinc; 4% aluminum), with a solidification range (melting range) of 381-387° C. Zamak 5 has the same composition as zamak 3 with the addition of 1% copper in order to increase strength, hardness, and corrosive resistance, with a solidification range (melting range) of 380-386° C. Zamak 7 has less magnesium than zamak 3 in order to increase fluidity and ductility, with a solidification range (melting range) of 381-387° C. Zamak 2 has the same composition as zamak 3 with the addition of 3% copper in order to increase strength, with a solidification range (melting range) of 379-390° C. It will be appreciated that a variety of other ZA alloys may be suitable for the flexible cabling embedding operations described herein.

The cables may be passed through the metal castings without an additional mechanism or post-machining operations or assembly after forming the metal casting. Specifically, because the thermally-resistant flexible cabling is embedded within a metal casting during die-casting, no additional mechanism, post-machining operations, or assembly after forming the metal casting is necessary. Further, embedding a cable through the casting occupies a smaller amount of space than methods that utilize the post machining. Additionally, by embedding the thermally-resistant flexible cabling within the metal casting during die-casting, communications through the cast material may be transmitted at high-speed and with high-density.

Figure 1:
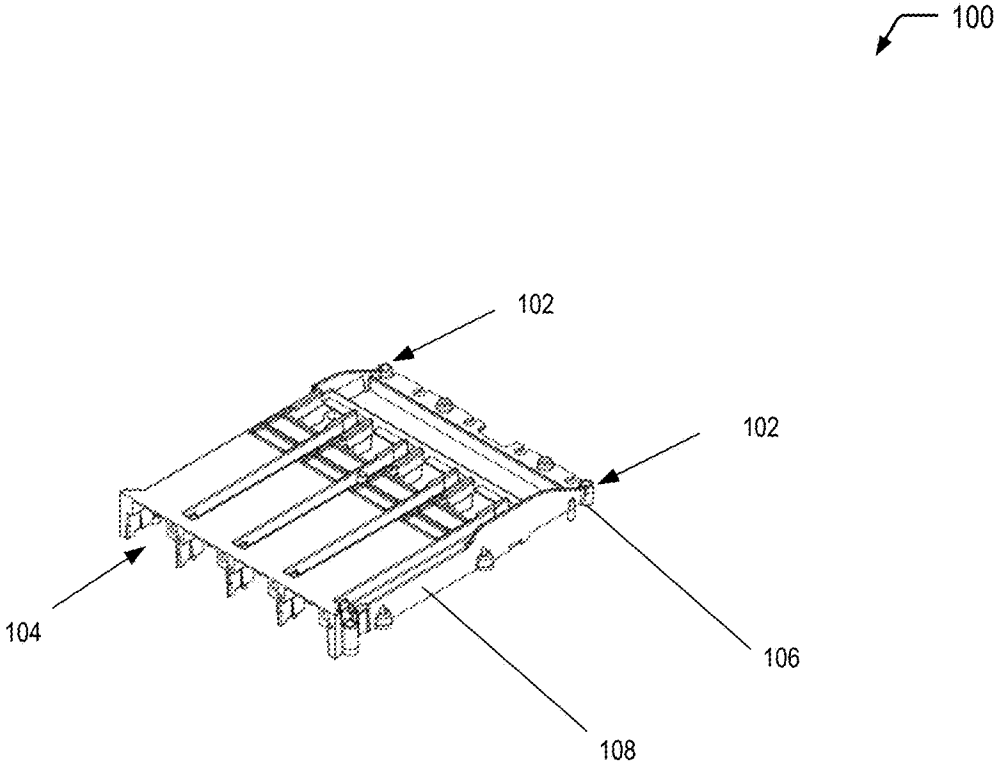
FIG. 1 (PRIOR ART)
FIG. 1 is a prior art diagram depicting an example of a metal casting containing screw posts that are utilized to contact pads on a printed circuit board for grounding.

FIG. 1 is a prior diagram 100 depicting an example of a metal casting containing screw posts 102 that are utilized to contact pads on a printed circuit board (not shown) for grounding. The example depicted in FIG. 1 represents an example of a "cubby/garage" including multiple channels 104 for passing individual cables.

When the metal casting is screwed onto a planar, the individual screw posts 102 align with copper pads on the printed circuit board that are electrically connected to a grounding layer on the printed circuit board. In the prior art design depicted in FIG. 1, screws go through the screw posts 102 and into an aluminum stiffener. The force of the stiffener pushes the backside of the screw posts 102 into the copper pads to establish grounding contacts 106. As described further herein with respect to FIG. 2, embedding thermally-resistant flexible cabling directly into a body 108 of the metal casting enables grounding by connection to a grounding plug on the printed circuit board, rather than using the screw posts 102 for contact.

Figure 2:
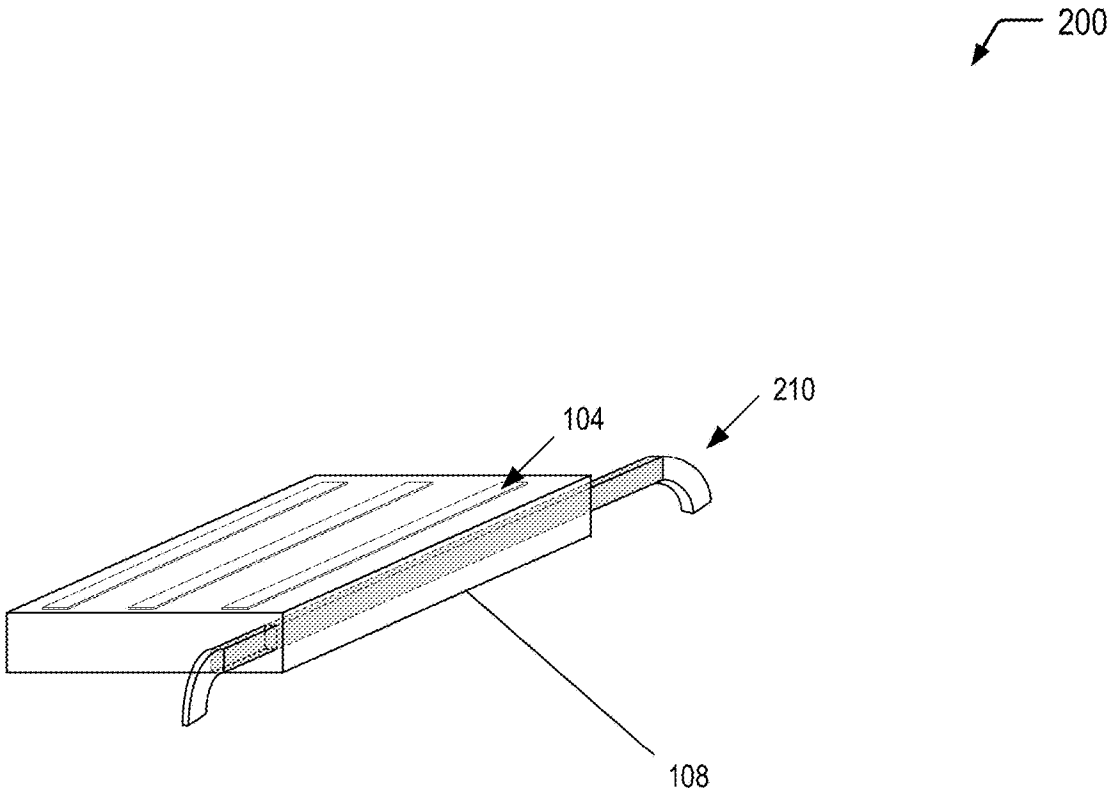
FIG. 2 is a diagram depicting an example of an article of manufacture containing thermally-resistant flexible cabling that is embedded within a metal casting, according to a particular embodiment.

FIG. 2 is a diagram 200 depicting an example of an article of manufacture containing thermally-resistant flexible cabling that is embedded within a metal casting, according to a particular embodiment. FIG. 2 represents an example of a grounding application where flexible thermally-resistant flexible cabling 210 with embedded, exposed metallurgy is used to create a grounding interconnect within the body 108 of the metal casting having an airtight seal. In contrast to the prior art example depicted in FIG. 1 where the screw posts 102 enable grounding contact, the addition of the thermally-resistant flexible cabling 210 directly into the body 108 enables the metal casting to be slotted into a grounding plug on the printed circuit board.

Figure 3:
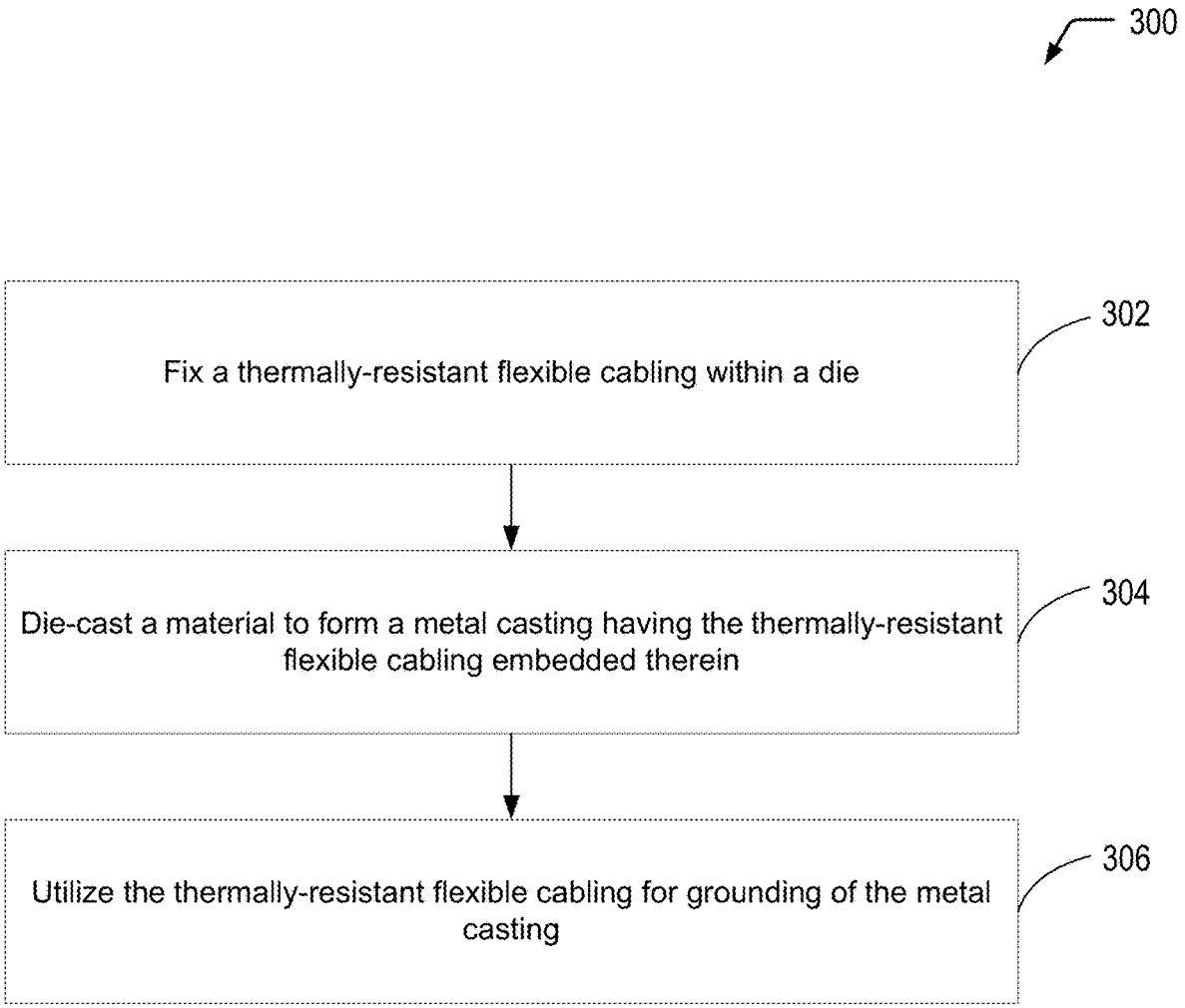
FIG. 3 is a flow diagram depicting a particular embodiment of a process of embedding thermally-resistant flexible cabling within a metal casting during die-casting.

Referring to FIG. 3, a flow diagram illustrates an example of a process 300 of embedding thermally-resistant flexible cabling within a metal casting during die-casting, according to one embodiment. In the particular embodiment depicted in FIG. 3, the process 300 also includes utilizing the thermally-resistant flexible cabling for grounding of the metal casting. In alternative embodiments, the embedded thermally-resistant flexible cabling may be utilized for signal communication or shielding, among other alternatives.

The process 300 includes fixing a thermally-resistant flexible cabling within a die, at 302. For example, in the embodiment depicted in FIG. 2, the thermally-resistant flexible cabling 210 extends through the body 108 of the metal casting to form a grounding interconnect. In alternative embodiments, the thermally-resistant flexible cabling may be internally grounded within the body of the metal casting. The process 300 includes die-casting a material (such as a ZA alloy) to form a metal casting having the thermally-resistant flexible cabling embedded within the metal casting, at 304. For example, the ZA alloy may correspond to zamak 3, zamak 5, zamak 7, or zamak 2 (among other alternatives).

In the case of zamak 3 with a melting range of 381-387° C., the thermally-resistant flexible cabling has sufficient high-temperature tolerance to withstand a die-casting temperature of at least 381° C. In the case of zamak 5 with a melting range of 380-386° C., the thermally-resistant flexible cabling has sufficient high-temperature tolerance to withstand a die-casting temperature of at least 380° C. In the case of zamak 7 with a melting range of 381-387° C., the thermally-resistant flexible cabling has sufficient high-temperature tolerance to withstand a die-casting temperature of at least 381° C. In the case of zamak 2 with a melting range of 379-390° C., the thermally-resistant flexible cabling has sufficient high-temperature tolerance to withstand a die-casting temperature of at least 379° C.

In the particular embodiment depicted in FIG. 3, the process 300 further includes utilizing the thermally-resistant flexible cabling for grounding of the metal casting, at 306. For example, in the embodiment depicted in FIG. 2, the thermally-resistant flexible cabling 210 may be utilized for grounding of the metal casting.

It will be understood from the foregoing description that modifications and changes may be made in various embodiments of the present invention. The descriptions in this specification are for purposes of illustration only and are not to be construed in a limiting sense. The scope of the present invention is limited only by the language of the following claims.

What is claimed is:

1. An article of manufacture containing thermally-resistant flexible cabling, wherein a portion of the thermally-resistant flexible cabling is embedded within a metal casting during die-casting, wherein the thermally-resistant flexible cabling is resistant to melting at casting temperatures for zinc aluminum alloys, and wherein the portion of the thermally-resistant flexible cabling that is embedded within a body of the metal casting is grounded to the body of the metal casting.

2. The article of manufacture of claim 1, wherein the thermally-resistant flexible cabling is embedded within the metal casting during die-casting of a zinc aluminum alloy.

3. The article of manufacture of claim 1, wherein the thermally-resistant flexible cabling is utilized for grounding of the metal casting.

4. The article of manufacture of claim 3, wherein the article of manufacture further includes a grounding interconnect within the body of the metal casting, wherein the grounding interconnect has an airtight seal.

5. The article of manufacture of claim 3, wherein the thermally-resistant flexible cabling extends through a body of the metal casting to form a grounding interconnect.

6. The article of manufacture of claim 3, wherein the thermally-resistant flexible cabling is passed through the metal casting without post-machining.

7. The article of manufacture of claim 2, wherein the ZA alloy is zamak 3.

8. The article of manufacture of claim 1, wherein the zinc aluminum alloy is zamak 5.

9. The article of manufacture of claim 1, wherein the zinc aluminum alloy is one selected from a group consisting of zamak 7 and zamak 2.

10. A die-casting process comprising:

fixing a thermally-resistant flexible cabling within a die; and after fixing the thermally-resistant flexible cabling within the die, die-casting an alloy to form a metal casting having a thermally-resistant flexible cabling embedded within the metal casting.

11. The die-casting process of claim 10, wherein die-casting the metal to form the metal casting comprises die-casting a zinc aluminum (ZA) alloy to form the metal casting.

12. The die-casting process of claim 11, wherein the ZA alloy is one selected from a group consisting of zamak 3, zamak 5, and zamak 7.

13. The die-casting process of claim 11, wherein the ZA alloy is zamak 2.

14. A process comprising:

embedding a thermally-resistant flexible cabling within a metal casting during die-casting of a zinc aluminum (ZA) alloy; and utilizing the thermally-resistant flexible cabling for grounding of the metal casting.

15. The process of claim 14, wherein embedding the thermally-resistant flexible cabling within the metal casting during die-casting comprises embedding the thermally-resistant flexible cabling within the metal casting during die-casting of a zinc aluminum (ZA) alloy.

16. The process of claim 14, wherein the thermally-resistant flexible cabling extends through a body of the metal casting to form a grounding interconnect.

17. The process of claim 14, wherein the thermally-resistant flexible cabling is internally grounded within a body of the metal casting.

18. The process of claim 15, wherein the ZA alloy is one selected from a group consisting of zamak 3, zamak 5, and zamak 2.

19. The process of claim 15, wherein the ZA alloy is zamak 7.

* * * * *